United States Patent [19]

Rosen

[11] 4,106,215

[45] Aug. 15, 1978

[54] WOOD IMPINGEMENT DRYER

[75] Inventor: Howard N. Rosen, Carbondale, Ill.

[73] Assignee: The United States of America as represented by the Secretary of Agriculture, Washington, D.C.

[21] Appl. No.: 705,230

[22] Filed: Jul. 14, 1976

[51] Int. Cl.[2] ..... F26B 19/00; F26B 25/06

[52] U.S. Cl. ..... 34/217; 34/13.8

[58] Field of Search ..... 34/13.4, 13.8, 25, 33, 34/34, 212, 216, 217, 28

[56] References Cited

U.S. PATENT DOCUMENTS

| | | | |
|---|---|---|---|
| 2,603,004 | 7/1952 | Quimby et al. | 34/13.4 |
| 3,335,499 | 8/1967 | Larsson | 34/13.8 |
| 3,434,222 | 3/1969 | Malmquist | 34/33 |
| 3,548,513 | 12/1970 | Taylor | 34/205 |
| 3,680,219 | 8/1972 | Koch | 34/13.4 |
| 3,977,091 | 8/1976 | Hortig et al. | 34/34 |

*Primary Examiner*—John J. Camby
*Attorney, Agent, or Firm*—M. Howard Silverstein; David G. McConnell

[57] ABSTRACT

A dryer is described, including elongated drying and steaming chambers through which wood to be dried travels. The wood is impinged with air and then steamed to a predetermined moisture content. Drying defects are minimized by humidity control, restraining devices to reduce warpage, and post-steaming of the wood for stress relief to reduce casehardening, checking, and collapse. The dryer is capable of adjusting to accept widely varying thicknesses of wood as well as long holdup times by the use of reversing switches on the drive to convey the wood through the dryer.

5 Claims, 6 Drawing Figures

WOOD IMPINGEMENT DRYER

BACKGROUND OF THE INVENTION (1) Field of the Invention

This invention relates to a drying apparatus which is used to dry and season lumber.

(2) Description of the Prior Art

Most artificially dried lumber is dried by the conventional batch kiln process, whereby the moisture content of the boards is carefully reduced to a desired level to produce the seasoned lumber. The kiln-dried lumber has traditionally been dried below 200° F with relative humidities kept high (40% to 80%) to avoid degradation of the wood, but more recently equipment has been developed to dry wood at temperatures above 212° F (high temperature drying). The limits of temperatures in commercial high temperature dryers have been about 250° F for hardwoods and 270° F for softwoods. Although high temperature drying reduces drying time compared to conventional kiln drying, high-temperature dried wood is more susceptible during drying to warp, collapse, end-checking, honeycomb, and casehardening than low-temperature dried wood.

Lumber dryers in the past have used circulation of air parallel to the drying surface. Impingement drying, whereby the gases are ejected perpendicular to the surface of the drying medium through slots or holes to form small air jets, has been commercially used for veneer drying. The impingement of the air increases the energy transfer to the veneer surface when compared to parallel air flow and thus increases drying efficiency.

To effectively use the impinging action of the air jets in an air impinging dryer, the air openings or orifice plates must be at a proper distance away from the surface of the wood, usually less than 2 inches. The usual impingement dryer is used to dry thin material of less than ⅛ inch and thus there is no need for adjusting the space between opposing banks of air jets. Lumber, ranging in thickness from ½ inch to 4 inches, requires adjustment of the opposing banks of air jets to effectively dry the wood.

Since the usual impingement dryer is used to dry thin material, drying times are very short compared to the time to dry lumber. A minimum lumber conveyance rate on the order of 1 foot per minute is required to maintain even drying and to prevent scorching of the wood surface by the air jets at higher drying temperatures. Drying of wood even at the most severe drying conditions takes several hours; thus, lumber would have to be passed several times through the usual continuous dryer in order to maintain the proper movement of the lumber.

Lumber drying can be divided into three stages: from initial moisture content to the fiber saturation point throughout the wood, from the surface first falling below the fiber saturation point to the wood falling below the fiber saturation point throughout, and from the wood falling below the fiber saturation point throughout to the final moisture content. The air velocity has a diminishing effect on drying rate in each of these stages from initial to final moisture content.

High quality lumber requires a minimum of physical defects in the dried lumber. Conventional kilns use a high humidity stress relief cycle at the end of the drying to relieve casehardening. Warpage is reduced in conventional kilns by applying heavy weights at the top of the kiln stack and in continuous dryers by compression rollers. The rollers in continuous kilns tend to gum with exudates from the wood and extra mechanical energy is required to force the wood against the restraining action of the rollers.

The main objective of this invention is to provide a more efficient and effective dryer for continuously drying lumber.

An object of this invention is to provide a continuous wood dryer with steam seasoning capabilities.

Another object of this invention is to provide a separate steaming section, whereby wood traveling through this section is relieved of internal stresses by the impingement of steam.

Another object is to provide a dryer that will accept a wide range of lumber thicknesses and still maintain the close distances between the lumber and ejector jets.

Another object of this invention is to provide a means by which lumber can be conveyed through a dryer of reasonable size without scorching the lumber or requiring multiple passes through the dryer for long drying times.

Another object of this invention is to provide a continuous dryer with a conveyance mechanism capable of handling a wide range of lumber thicknesses while mechanically restraining the wood to prevent excessive warpage.

As discussed earlier in this disclosure, higher air velocities are more efficiently used in the first stage of drying. Another object of this invention is to provide variable air flow control along the length of the dryer to more efficiently use the air in drying the wood.

SUMMARY OF THE INVENTION

This novel wood dryer consists of an elongated drying chamber followed by a steaming chamber through which lumber to be dried is conveyed. As the lumber progresses through the dryer, air or steam impinges on the surface of the wood to season the wood to the proper moisture content.

The drying chamber consists of moist blower section producing a current of moist air, a heating section for heating the air, and a conduit means for distributing the heated air into the drying chamber in several streams along the length of the chamber so that the air impinges on the wood traveling through the chamber. The dryer section is maintained at a desired temperature and humidity by controlled amounts of heater fuel, steam, and air exhaust. The steaming section consists of a blower section producing circulation of the steam, a steam section for introducing the steam, and a conduit means for distributing the heated air into the steaming chambers in several streams along the length of the chamber so that the steam impinges on the wood traveling through the chamber.

BRIEF DESCRIPTION OF THE DRAWING

The description of the dryer will become more apparent when read in conjunction with the following drawings.

DESCRIPTION OF THE PREFERRED EMBODIMENTS

Figure 1:
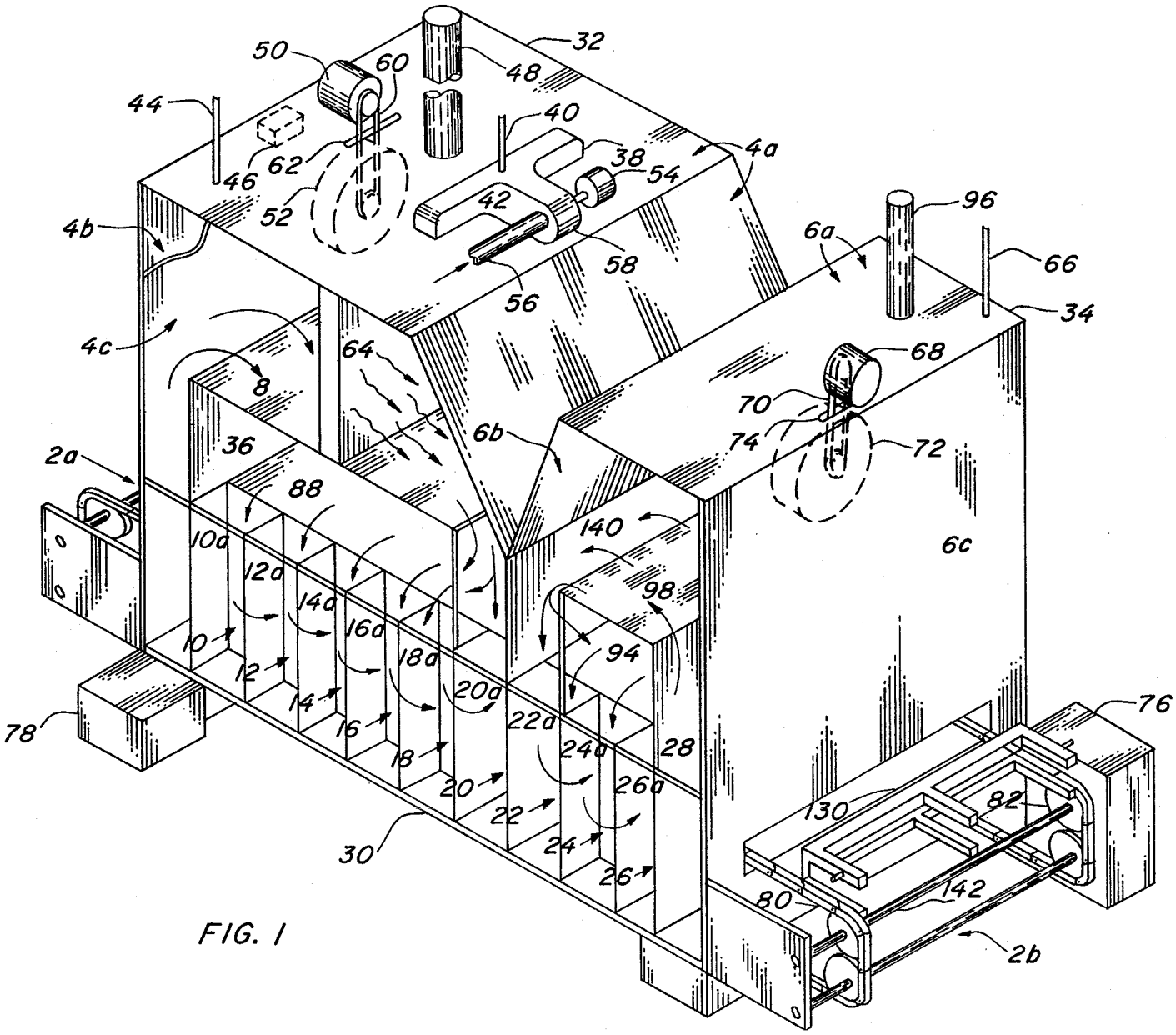
FIG. 1. A simplified perspective view illustrating a wood dryer constructed according to the invention.

Referring first to FIG. 1, illustrated generally is a lumber dryer constructed according to the invention. The dryer includes an infeed platform, 2*a*, at which the lumber is loaded by hand to be dried, and an outfeed platform, 2*b*, from which the dried lumber is removed by hand. Although several carriages are used to transport the wood through the dryer, only one, 130, is shown. Along the raised floor of the dryer at 30 is a housing structure defining an elongated drying section, 32, and steam conditioning section, 34, for the dryer. The dryer chamber extends along and through a multiple drying section, designated by even numbers 10 through 20, and through a multiple steaming section, designated by even numbers 22 through 26.

Extending along the dryer, moving through the drying and steaming chambers, and returning in the raised section below the floor, 30, is a chain conveyor, 80, for transporting carriages of wood from end 2*a* to 2*b*. The chain is driven by a suitable power drive means, 76, and connected to sprockets, 82, and support shafts, 142. The lumber is transported through the dryer by a series of pulleys and chains with a variable speed drive. A minimum speed of wood through the dryer on the order of 1 foot per minute provides even drying by the jets without scorching. Retention time in the dryer can be greatly increased by reciprocating the chain drive over a small segment of the dryer for several cycles before moving a small distance along the dryer; i.e., reciprocating at 1 foot per minute over a 6-inch section for 10 cycles and then moving ahead 1 foot; thus increasing retention time by 11 times that without reciprocation of the chain drive. Reversing switches in the motor are activated to produce the desired movement.

The dryer is contained by walls, such as 4*b* and 6*b*, over the sides of the drying and steaming section (removed to expose the interior of the dryer) and walls 4*c* and 6*c* extending transversely between and joining with the side walls, and a top structure, 4*a* and 6*a*, spanning and joined to the sides and end walls of the dryer. Interior walls of the dryer include horizontal walls, 8, extending over dryer sections 10 through 18 while traversing the width of the dryer; wall 98 extending over steaming sections 24 and 26 while traversing the width of the dryer; end walls 36 and 28 extending from the floor, 30, to walls 8 and 98, respectively; and vertical wall 140 extending from the floor, 30, to the narrow portion of the dryer at the joining of the top structure, 4*a* and 6*a*, while traversing the width of the dryer. Expanse 88 covers dryer sections 10 through 20 and extends substantially across the width of the drying section. Expanse 94 covers steaming sections 22 through 26 and extends substantially across the width of the steaming section. The side wall 4*b*, end wall 4*c*, top structure 4*a*, interior walls 36, and expanses 8 and 88 comprise casing structure defining layered plenum chamber for providing hot air to drying chambers 10 through 20. Side wall 4*b*, end wall 6*c*, top structure 6*a*, interior walls 6*b* and 140, and expanses 98 and 94 comprise casing structures defining layered plenum chamber for providing hot air to steaming chambers 22 through 26.

Suitably mounted inside the plenum chamber's adjacent ends, 4*c* and 6*c*, are fans or blowers, indicated generally with dashed lines at 52 and 72. Blower 52 is driven by a variable speed electric motor, 50, mounted on top structure 4*a* and connected to the blower through a suitable belt well, such as 60, by belt 62; whereas, blower 72 is driven by an electric motor, 68, mounted on top structure 6*a* and connected to the blower through a suitable belt well, such as 74, by belt 70.

Mounted inside the drying section plenum chamber and located toward the discharge end of the dryer from blower 52 is a heating element, 64, enclosed on top by wall 4*a* and on bottom by wall 8 for heating air in the drying section. The heating section includes conventional burners (not shown), which, when activated, heat air flowing through the section. A feed manifold, 38, is provided for feeding fuel to the burner units of the heating section. A mixing conduit, 42, connects the manifold, 38, to a blower, 58, which is driven by a motor, 54. Air, provided by the blower through conduit 56, and a suitable source of fuel, such as fuel gas, provided through conduit 40 are mixed in conduit 42 before being supplied to the burner units where it is burned to heat air in the dryer. Temperature in the dryer is controlled by regulating the amount of fuel to the burners.

Located inside the plenum chamber of the drying section before the intake of the blower, 52, is an appropriate humidity sensing and controlling device, 46, such as a wet bulb controller. Humidity is controlled in the drying section by venting part of the air returned on circulation of the air within the drying section through vent 48 or by adding steam through conduit 44. Air vent 96 and steam conduit 66 are provided in the plenum chamber in the steaming section.

Drying and steaming chambers 10 through 26, as will be described in more detail, are comprised of movable split sections. The drive for raising or lowering the sections is an electric gear motor, 78.

Illustrated in a simplified outline inside the dryer, vertical walls 10*a* through 18*a*. Side wall 4*b*, and floor 30 form a series of vertically disposed ducts through which air flows from the drying plenum into the drying chambers, and vertical walls 22*a* through 26*a*, side wall 6*c*, and floor 30 form similar ducts through which steam flows from the steam plenum into the steaming chambers.

The general nature of air heating and flow that occurs in the dryer section with blower 52 and the heating section in operation is considered. The blower produces a current of air which flows along the plenum chamber bound on the top by top structure 4*a*. As the air passes through heating section 64, it is heated to the desired temperature. The heated air flows into the plenum chamber directly below bound on the top by interior wall 8, before flowing downwardly in paths along opposite sides of the dryer through the vertically disposed ducts adjacent to sections 10 through 20. From these, the air is ejected onto opposite surfaces of the wood in the drying chambers, as will be described in more detail later.

The impingement of the air on wood traveling through the chamber produces drying of the wood. The air returns by flowing horizontally through and along the drying chamber towards end 2a of the dryer. The air then flows upward out of drying section 10 back into the plenum chamber where it is recirculated by blower 52. A small portion of the air is not recirculated, but vented to the atmosphere through vent 48. Fresh air is drawn into the dryer through conduit 56 to replace vented air.

Steam flow in the steaming section is similar to that in the dryer section. Blower 68 produces a current of air which flows along the plenum chamber bound on the top by structure 6a, into the chamber directly below bound on the top by interior wall 98, before flowing downwardly in paths along the opposite sides of the dryer through the vertically disposed ducts adjacent to sections 22 through 26. The steam is then ejected onto the opposite surfaces of the wood in the steaming chamber, as will be described in more detail later. The steam returns by flowing horizontally towards end 2b of the dryer. The steam then flows upward out of the steaming section, 26, where it is recirculated by blower 72. If necessary, excess steam is vented to the atmosphere through vent 96.

Figure 2:
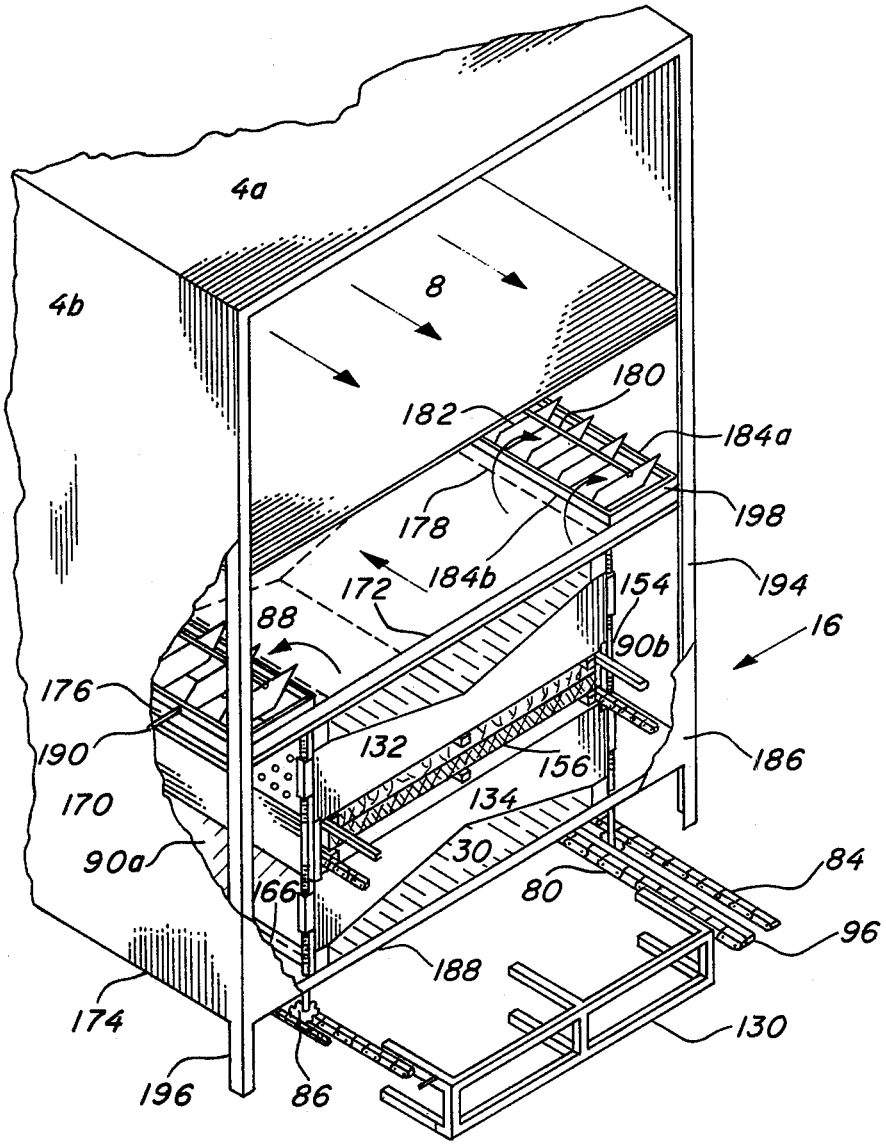
FIG. 2. A fragmentary perspective section view taken in the plane of line 2—2 of FIG. 1, showing the use of air jets as suggested by the invention.

FIG. 2 illustrates portions of dryer section 16 in more detail, describing the frame construction and flow control of the section. Extending transversely across the dryer are rectangular frame assemblies such as the one illustrated comprising upper and lower transverse members 188 and 172 and upright members 194 and 196, extending between and joining the transverse members. Extending along the dryer and joining adjacent frame assemblies on each side of the dryer are spaced upper members 176 and 178 and spaced lower members 174 and 166.

Ducts 90a and 90b, earlier described as functioning to convey air between the plenum and drying chambers, are comprised of side panel 170 closing off the outer side of the duct; the floor of the dryer, 30, closing off the duct's base; and partitions such as the one shown partially at 16a bonding the duct adjacent to the forward and rear ends of the dryer section.

An air flow control system comprising an elongated, rectangular frame including side bars 184a and 184b and end bar 198 mounted or longitudinal members 176 and 178 and on transverse member 172.

Within the dryer section, upper dryer box 132 and lower dryer box 134 are connected on opposing adjusting rods 154 for the section. The rods are moved to lower or raise the boxes by a sprocket, 86, driven by chain 84. The boxes are spaced apart to accommodate the travel of the wood, 156, through the various sections of the dryer. In each of the sections 10 through 26, upper and lower boxes are spaced at the same distance apart, all communicating with the ducts supplying the drying and steaming sections.

Wood restraining carriages, 130, are returned to the front end of the dryer through the cavity formed by the extension of upright members 196 and 194 and the floor of the dryer, 30. A carriage guide, 96, runs above the chain conveyor, 80, between the dryer boxes and below the floor, 30, of the dryer to maintain the carriage, 130, in a fixed position.

Figure 3:
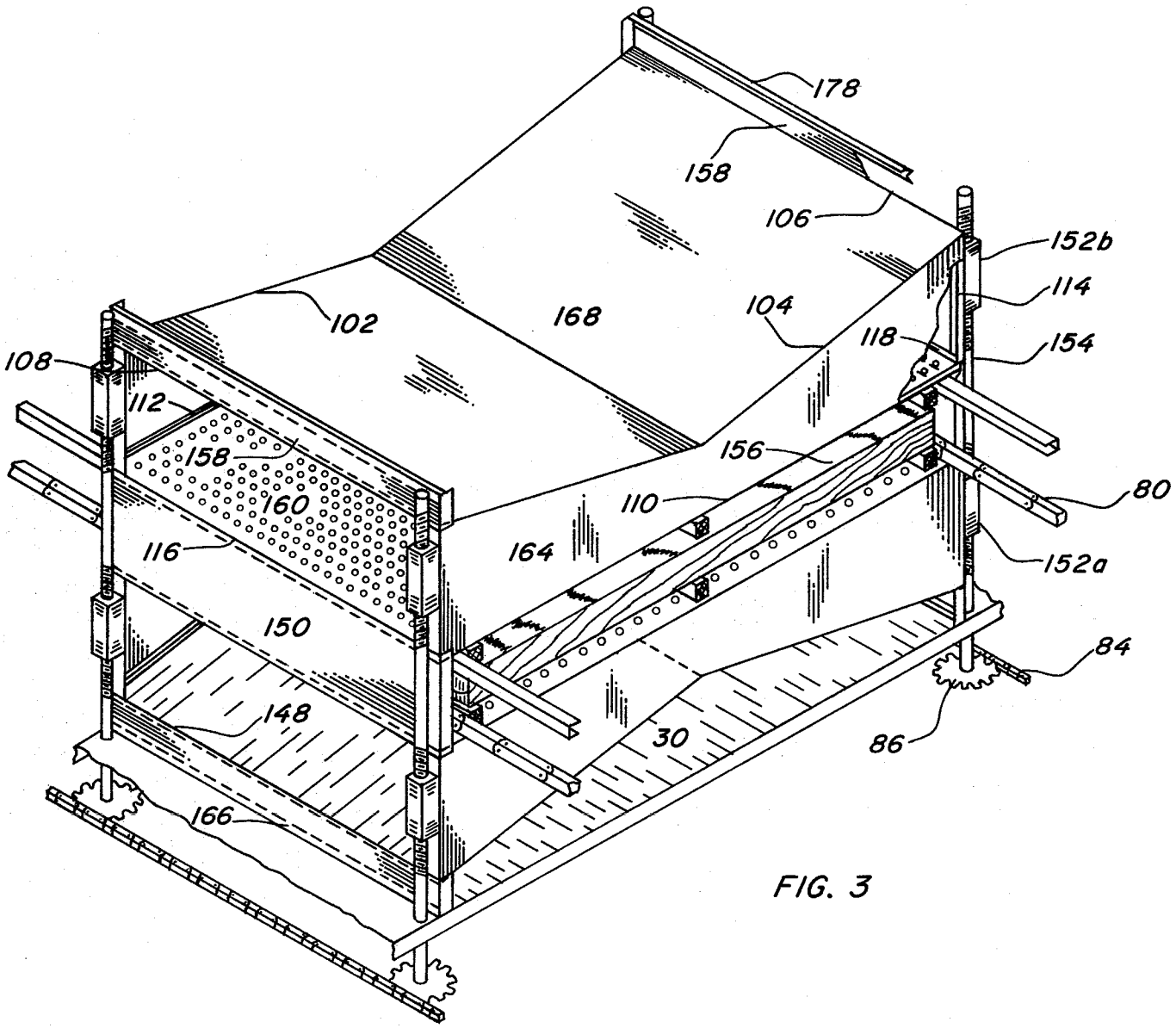
FIG. 3. A fragmentary perspective view on a larger scale than FIG. 2, illustrating opposing dryer boxes, ejector orifices, and gear drive to vary the distances between ejector plates.
Figure 4:
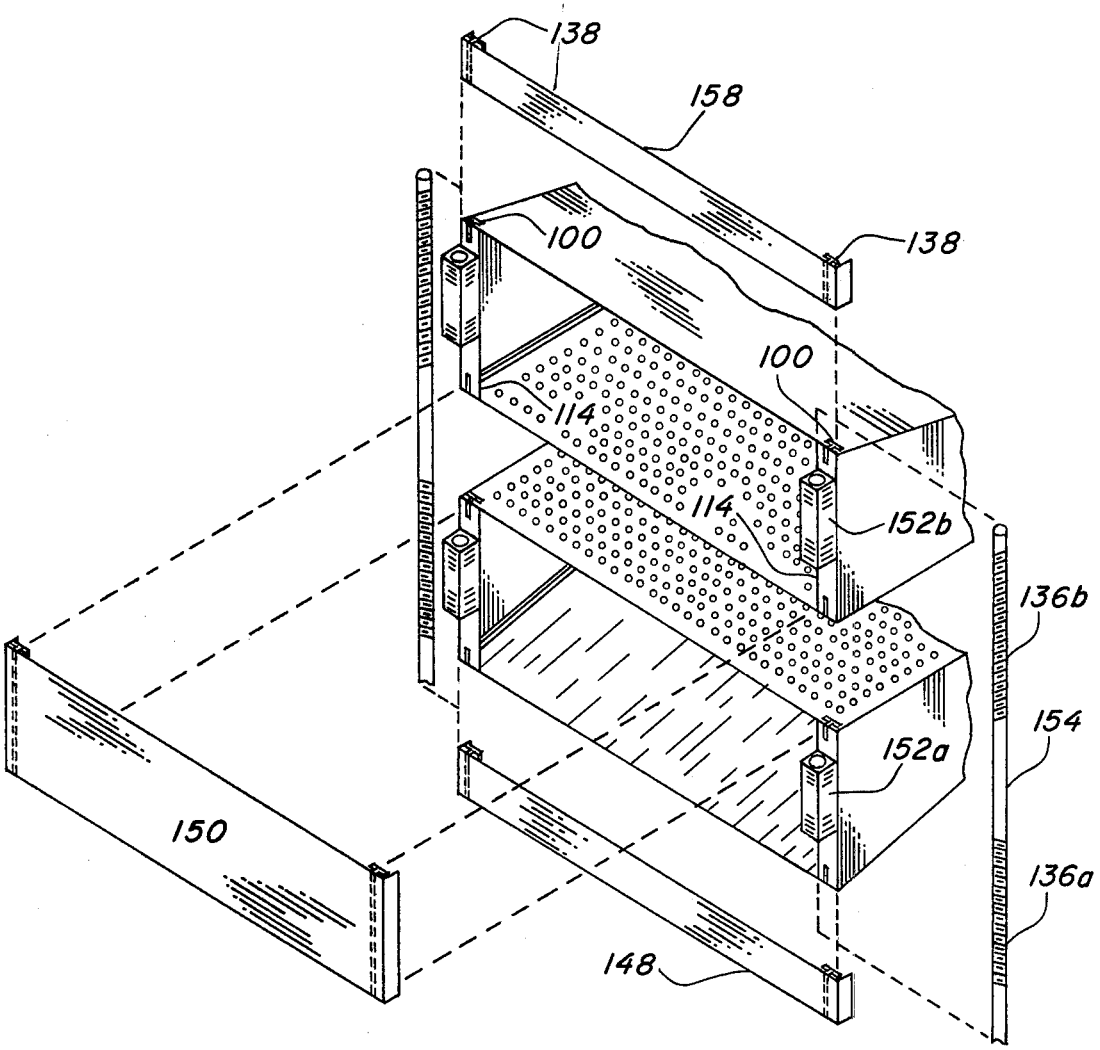
FIG. 4. A fragmentary perspective exploded view illustrating details of drive mechanism for varying distances between ejector plates.

Referring now to FIGS. 3 and 4, which illustrate the dryer ejector boxes and gear drive mechanism to change the distances between a pair of boxes, the dryer boxes, such as 132 and 134, are supported in the dryer chamber by adjusting rods, 154, and upper and lower curtains 158 and 148, respectively.

The construction of upper dryer box 132 comprises top transverse members 102 and 104, tapered in from the open ends of the box and extending to top crossmembers 106 and 108; bottom lower members 110 and 112 joined to bottom crossmembers 116 and 118; and vertical members, 114, connecting the top and bottom of the box. The roof of the dryer box 168 with sides, 164, form an elongated section, which covers the orifice plate, 160, supported by members 110, 112, 116, and 118. The orifice plate is constructed of small holes which extend through the plate, the holes being arranged in rows extending across and along the dryer box. The construction of lower drying box 134 is identical to 132. The boxes are positioned so that the orifice plates are opposite the surface of the wood, 156, to be dried.

Dryer boxes are moved further and closer apart along the vertical adjusting rods, 154, at each of the four corners of the upper and lower dryer boxes. A common chain, 84, extending to the sprockets, 86, on each adjusting rod produces the same travel along each rod. Internally threaded collars, 152a and 152b, are connected to each vertical member, 114 to contain the adjusting rods, 154. Opposite direction of travel of upper dryer box 132 and lower dryer box 134 is accomplished by inscribing the threads on adjusting rod 154 for the lower collar, 152a, in the opposite direction to those at 136b for upper collar 152b. Curtains 158, extending between upper member 178 and the top of upper dryer box 132; curtains 150, extending from the bottom of dryer box 132 to the bottom of dryer box 134; and curtains 148, extending between lower dryer box 134 and lower member 166, are used to cover any gaps which are created between dryer boxes, between upper dryer box 132 and roof 162, and between dryer box 134 and floor 30, when the distances between the boxes are changed. The boxes moving against the curtains are guided by slots, 100, in the vertical members, 114, of the dryer boxes, connected to sliders, 138, protruding from the inward surface of the curtains (FIG. 4).

Figure 5:
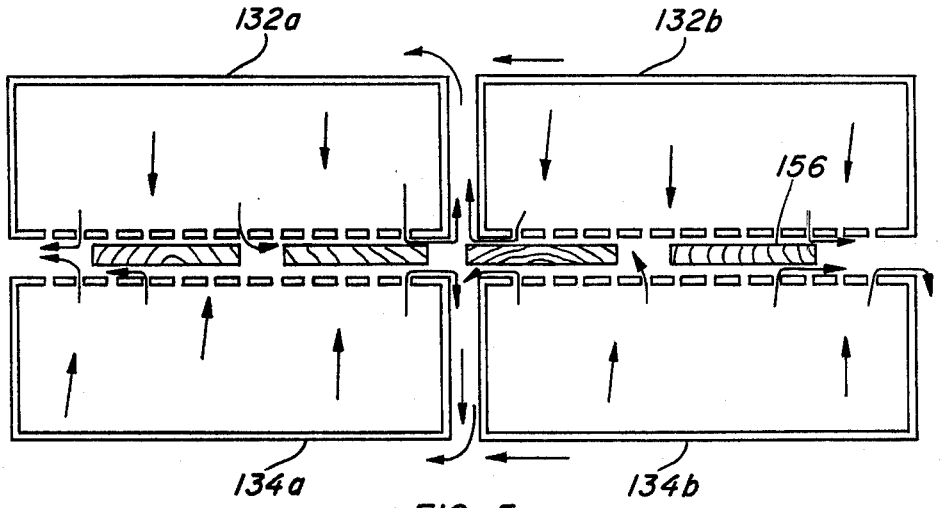
FIG. 5. A simplified, longitudinal, cross-sectional view, on a smaller scale than FIG. 3, illustrating how air is ejected onto surfaces of the lumber traveling adjacent to the ejectors of FIG. 3.

Explaining how the dryer boxes function to introduce air into the drying chamber and referring to FIGS. 2, 3, and 5, it will be recalled that air flows from the plenum chamber downwardly along the sides of the dryer ducts, 90a and 90b. Ducts 90a and 90b communicate with upper and lower dryer boxes from opposite ends and, hence, introduce air into the dryer boxes from opposite sides of the dryer. Air within the hollow sections of the dryer boxes flows out through the holes and is directed against opposite faces of wood traveling through the dryer.

FIG. 5, showing adjacent dryer boxes 132a and 132b and lower dryer boxes 134a and 134b, indicates how air or steam flow takes place out of the orifice holes and onto opposite faces of the wood (arrows) and, after such impingement, flows along the sheet countercurrent to the direction in which the wood moves through the dryer (in the drying section) or concurrent to the direction in which the wood moves (in the steaming section). The air or steam in returning to the blower intakes of the dryer flows between the dryer boxes in the drying and steaming chambers provided by the spaced apart section of the dryer and then along the cavities above the dryer boxes.

Dryer sections 10, 12, 14, 18, 20, 22, 24, and 26 have a construction similar to 16 and include ducts 90a, 90b, and orifice plates, as described for section 16. Flow control can be included for all dryer sections but are usually omitted for steaming sections.

Figure 6:
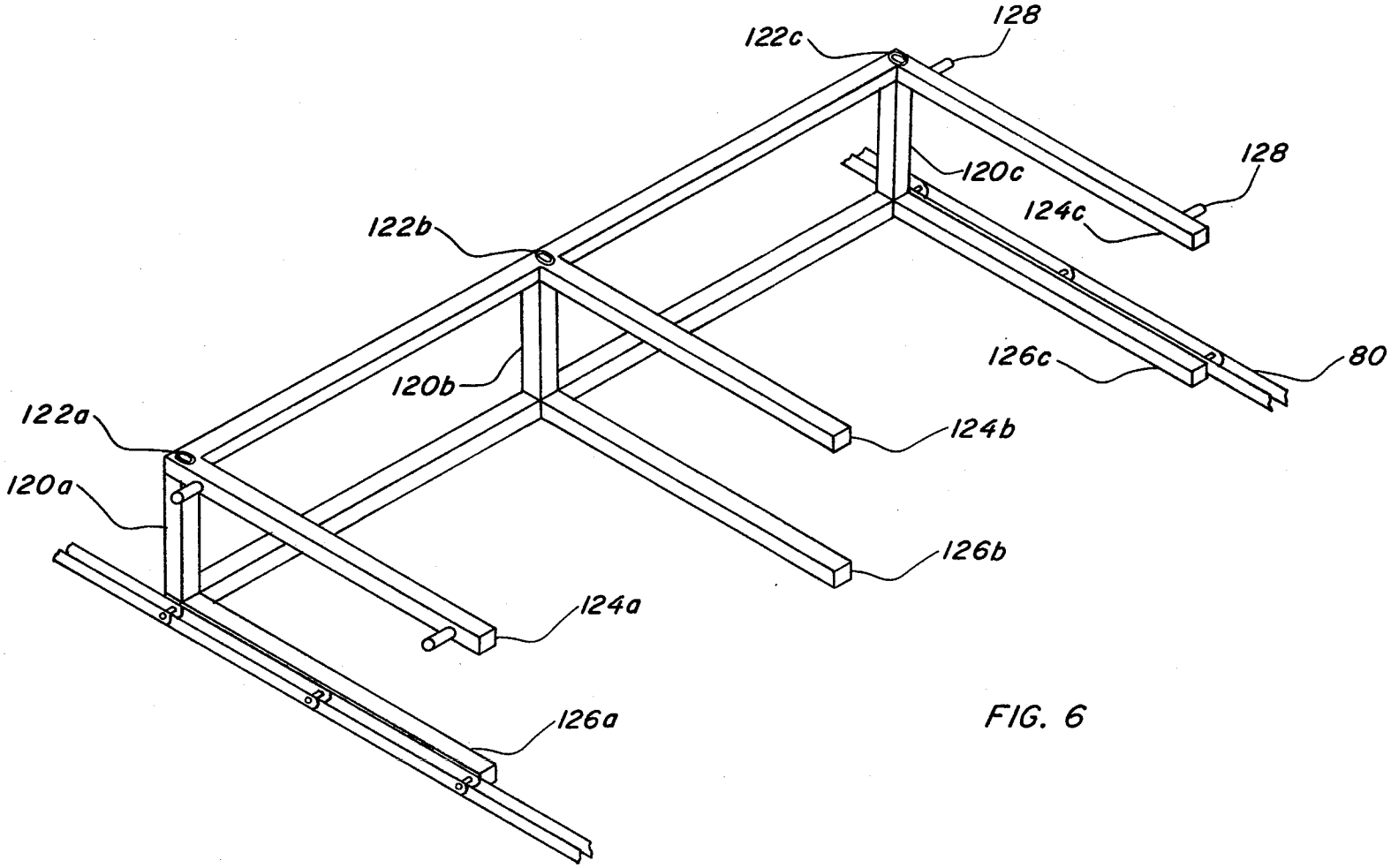
FIG. 6. On a larger scale than FIG. 3, a perspective of a restraining carriage used to convey lumber through the dryer.

Referring to FIG. 6, a restraining carriage is generally illustrated in which the wood to be dried is conveyed through the dryer, is described in more detail. The bottom section of the carriage is comprised of three longitudinal prongs, 126*a*, 126*b*, and 126*c*, two prongs of which (126*a* and 126*c*) are attached to the chain drive, 80, an opposite sides of the dryer. Connected perpendicular to these prongs and extending vertically are removable and adjustable rods, 120*a*, 120*b*, and 120*c*. Extending from the top of rods 120*a*, 120*b*, and 120*c*, parallel to prongs 126*a*, 126*b*, and 126*c* are prongs 124*a*, 124*b*, and 124*c* fastened to rods 120*a*, 120*b*, and 120*c* by restraining bolts 122*a*, 122*b*, and 122*c*. The guide pins, 128, protruding at the end of prongs 124*a* and 124*b* are mated to guide rail 96 (FIG. 2) to facilitate movement of the restraining carriage through the driver. Different thicknesses of wood can be accommodated by changing rods 120*a*, 120*b*, and 120*c* to the desired length necessary to handle the wood being dried.

EXAMPLE

A specific example of the use of this apparatus according to the invention and a comparison of this apparatus with "conventional kilning" drying silver maple lumber 1 inch thick and 6 inches wide will be presented.

The drying schedules were set as listed in Table 1.

Table 1

| Dryer Hours | Conventional Kiln Schedule Dry Bulb, ° F | Wet Bulb, ° F | Moisture Content, % |
|---|---|---|---|
| 0 | | | 80 |
| 0– 45 | 130 | 123 | 50 |
| 45– 52 | 130 | 120 | 43 |
| 52– 72 | 130 | 115 | 30 |
| 72– 84 | 140 | 100 | 23 |
| 84– 94 | 150 | 100 | 17 |
| 94–104 | 160 | 110 | 12 |
| 104–126 | 180 | 130 | 6 |
| 126–141 | 160 | 135 | 8 |
| | Impingement Schedule | | |
| 0 | | | 85 |
| 0–4 | 275 | 180 | 5.7 |
| 4–5½ | 200 | 190 | 7.5 |

A comparison of the properties of the boards dried by conventional kiln and those dried in the impingement dryer follow in Table 2.

Table 2

| | Conventional Kiln | Impingement Dryer |
|---|---|---|
| Green moisture content, % | 80 | 85 |
| Dry moisture content, % | 8 | 7.5 |
| Drying and conditioning time, hours | 141 | 5.5 |
| Dry twist, inches | 0.22 | 0.12 |
| Dry bow, inches | 0.10 | 0.09 |
| Dry crook, inches | 0.08 | 0.03 |
| Dry cup, inches | 0.10 | 0.08 |
| Volumetric shrinkage | 10.9 | 8.2 |

Surface and internal physical defects such as honeycomb, checking, collapse, and casehardening were as good as or better in the impingement dried lumber than in the conventional kiln-dried lumber.

Referring to FIGS. 1 and 2, the orifice plates, 160, contained 3/16-inch holes distributed to contain 3.2% of the surface of the plates. The electric gear motor, 78, was adjusted so that the distance from the surface of the wood to the plates was 1 inch.

The chain drive motor, 76, can be set to accommodate reasonable sized dryers over long drying times. A chain drive motor, 76, causing the chain drive, 80, to move at 1 foot per minute, and means for reciprocating 9 times in 1-foot cycles (6 in. up and 6 in. back) before moving forward 1 foot (one cycle) would require a 24-foot-long drying section and a 9-foot-long steam conditioning section to dry and condition the lumber in the 5½ hours required in the above example.

As evident from the example, it is possible to dry silver maple lumber with initial moisture content of 85% into dry lumber with a moisture content of 7.5% with physical characteristics suitable for commercial use. In addition, the continuous process for drying and steam conditioning lumber comprising impingement may be accomplished at a temperature of about from 100° to 350° F., and a humidity of about from 5% to 90%, followed by impinging steam onto the resulting dried lumber.

With the dryer described herein, removal of moisture from wood takes place quite rapidly by reasoning of the impingement action produced in the drying chamber through orifice ejector holes. For example, lumber processed in the dryer described herein may in the relatively short time of 4 to 6 hours have a total dry moisture content of less than 10% by weight. Efficient drying of the wood is facilitated by the fact that air flowing into the dryer boxes and, hence, out of the holes onto the wood, can be regulated by the controls which are adjustable to increase or decrease flow of air permitted through the various ducts provided along the side of the drying chamber. Thus, a rapid air flow may be used in the intake of the dryer, where, as stated earlier, air velocity has a large contributing effect on drying rate of high moisture content wood, and a low air flow might be used in the final drying section, where the wood might be below the fiber saturation point and the air velocity will have only a slight effect on wood drying rate.

While a particular dryer has been illustrated in the invention, variation may readily be made without departing from the spirit of the invention. For example, a dryer may be constructed having a different number of drying sections or steaming sections than shown. Also, the arrangement and type of ejectors on the plates may vary, depending on circumstances. Other variations and modifications will become apparent to those skilled in the art, and it is desired to cover all such variations and modifications which come within the scope of the invention.

Having thus disclosed my invention, I claim:

1. An apparatus for the continuous drying and seasoning of lumber comprising:

an elongated drying section, an elongated steam condition section sequentially communicating with said drying section, a housing structure encompassing said drying section and said steam conditioning section, means for continuous transportation of lumber longitudinally and sequentially through said drying and steam conditioning sections, means for the impingement of hot air onto lumber being transported through said drying section, means for impinging steam onto lumber being transported through said steam conditioning section.

2. The lumber drying apparatus according to claim 1, which further includes means for allowing a wide range of air flow and variable air flows along said dryer.

3. An apparatus as described in claim 1 wherein the means for continuous transportation of lumber longitudinally and sequentially through the drying and steam conditioning sections includes a chain drive, a chain drive motor, and means for reciprocating the chain drive backwards and forwards to control the time of exposure of the lumber to the impingement of hot air and steam.

4. An apparatus as described in claim 1 wherein the means for continuous transportation includes a carriage for holding and for mechanically restraining said lumber.

5. An apparatus as described in claim 1 wherein the means for impinging hot air and the means for impinging steam onto the lumber includes a means for accommodating varying thicknesses of lumber.

* * * * *